US007914234B2

(12) United States Patent
Large et al.

(10) Patent No.: US 7,914,234 B2
(45) Date of Patent: Mar. 29, 2011

(54) METHOD AND APPARATUS FOR RESTRAINING A TENDON TOP CONNECTOR IN REVERSE LOADING CONDITIONS

(75) Inventors: Edward Sean Large, Houston, TX (US); Christopher Paul Hutchinson, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 391 days.

(21) Appl. No.: 12/124,897

(22) Filed: May 21, 2008

(65) Prior Publication Data

US 2009/0290939 A1 Nov. 26, 2009

(51) Int. Cl.
*E02D 5/54* (2006.01)

(52) U.S. Cl. ..... 405/224; 405/223.1; 405/224.2

(58) Field of Classification Search ..... 405/223.1, 405/224, 224.2, 224.3, 224.4; 166/367, 345, 166/350, 359
See application file for complete search history.

(56) References Cited

U.S. PATENT DOCUMENTS

| | | | | |
|---|---|---|---|---|
| 4,468,205 | A | 8/1984 | Pedersen | |
| 4,491,439 | A | 1/1985 | Watkins | |
| 4,871,282 | A | 10/1989 | Jennings | |
| 5,020,942 | A | 6/1991 | Pallini, Jr. et al. | |
| 5,873,678 | A * | 2/1999 | Moses | 405/223.1 |
| 5,899,638 | A | 5/1999 | Pallini, Jr. et al. | |
| 6,007,275 | A | 12/1999 | Borseth | |
| 6,648,074 | B2 * | 11/2003 | Finn et al. | 405/224.3 |
| RE38,458 | E | 3/2004 | Pallini, Jr. et al. | |
| 6,739,804 | B1 * | 5/2004 | Haun | 405/195.1 |
| 6,789,981 | B2 | 9/2004 | Pollack | |
| 7,287,935 | B1 | 10/2007 | Gehring | |
| 7,467,914 | B2 * | 12/2008 | Finn et al. | 405/224.3 |
| 7,621,698 | B2 * | 11/2009 | Pallini et al. | 405/223.1 |
| 2007/0201955 | A1 * | 8/2007 | Mohr | 405/224.3 |
| 2009/0092448 | A1 * | 4/2009 | Pallini et al. | 405/224 |

* cited by examiner

*Primary Examiner* — Frederick L Lagman
(74) *Attorney, Agent, or Firm* — Wong, Cabello, Lutsch, Rutherford & Brucculeri, L.L.P.

(57) ABSTRACT

A tendon top connector for a moored, floating structure such as a tension leg platform, a tension leg buoy or the like has a bowl-shaped extension on the member which transfers the tension of the tendon to the flex connector. A dome-shaped structure at least partially surrounds the bowl-shaped extension but is spaced apart from it to permit at least some rotational movement of the connector. The dome-shaped structure may be attached by clamps or other mounting means to a flange member affixed to the tendon porch. This arrangement provides a load path when the tendon top connector is reverse loaded that extends from the tendon length adjustment joint, through slips, through the bowl-shaped extension, through the dome-shaped structure, through the segmented clamps, and finally into a flange attached to the tendon porch. In this way, detachment of the tendon top connector is prevented if a reverse load is applied such as may occur during extreme metocean conditions.

16 Claims, 2 Drawing Sheets

METHOD AND APPARATUS FOR RESTRAINING A TENDON TOP CONNECTOR IN REVERSE LOADING CONDITIONS

CROSS-REFERENCE TO RELATED APPLICATIONS

None

STATEMENT REGARDING FEDERALLY SPONSORED RESEARCH OR DEVELOPMENT

Not Applicable

BACKGROUND OF THE INVENTION

1. Field of the Invention

This invention relates to mooring devices for offshore structures. More particularly, it relates to connectors for joining the upper portion of a subsea tendon to a floating structure such as a tension leg platform, tension leg buoy, or the like.

2. Description of the Related Art Including Information Disclosed Under 37 CFR 1.97 and 1.98

A tension-leg platform (TLP) is a vertically moored floating structure normally used for the offshore production of oil or gas. A tension leg buoy (TLB) is a similar moored, floating structure whose topsides are typically comprised of unmanned equipment.

A TLP is permanently moored by means of tethers or tendons grouped at each of the structure's corners. A group of tethers is called a tension leg. The tethers have relatively high axial stiffness (low elasticity), such that virtually all vertical motion of the platform is eliminated. This allows the production wellheads to be located on the deck of the platform (connected directly to the subsea wells by rigid risers), instead of on the seafloor. This makes for a less expensive well completion and gives better control over the production from the oil or gas reservoir.

U.S. Pat. No. 7,287,935 describes a tendon assembly that is secured to a buoyant platform and extends down to a counterweight located near the lower end. A piling is embedded in the sea floor. A socket at the counterweight telescopingly slides over the upper end of the piling to prevent lateral movement of the platform. A dampening chamber is located between the socket and the piling. Ports for the chamber are arranged to allow a faster downward movement of the piling than upward movement.

U.S. Pat. No. 5,899,638 describes a segmented ring that forms a set of latches for a tendon top connector on a floating platform. The latches reside in a housing and have either a groove or thread profile on an upper internal surface. The grooves interface with a mating groove profile on the tendon. The latches rotationally pivot backward and forward from the outer portion of the bottom surface. When the latches are forward, the profile in the internal surface engages the mating profile of the tendon top joint. When the latches are swung out, these profiles clear and permit the top joint to pass through the connector. Retraction of the latches is provided by application of force on the inside surface of an annular extension on the outer portion of the latches. The top connector is said to allow for passive dynamic engagement of the connector to the tendon top joint. When the latches are permitted to move inward, contact is made with the mating profile on the tendon top joint. Downward movement of the tendon relative to the connector causes the passing profile of the top joint to engage the profile of the latches and engage the latches into the top joint. Upward movement of the tendon relative to the connector causes the latches to be pivoted out of the way, allowing the top joint to pass through the connector unrestricted.

U.S. Pat. No. 4,491,439 describes a latch that connects tendons run from a floating platform to a socket in a foundation on the sea floor. The latch includes a latch body having a plurality of dogs disposed within and urgible outward from the latch body. A piston is disposed within the latch body above the dogs and moves downwardly when released to urge the dogs outwardly from the body into latching engagement with the socket. A trigger mechanism in the latch releases the piston when the latch body lands in the socket and contacts a trigger pin projecting upwardly from the bottom of the socket. A series of wedges are disposed on the exterior of the body and inhibit lateral movement of the body relative to the socket when the tendon is subjected to a bending load.

U.S. Pat. No. 5,020,942 describes a tension leg platform top connector for connecting a tendon to the platform. The top connector has a housing with a bore containing a conical shoulder. Several segments locate on the conical shoulder and slide between an upper retracted position to an engaged position. In the engaged position, threads on the interior of the segments engage threads formed on the exterior of the tendon. A cam plate slides the segments down when the cam plate is rotated. A guide ring mounts outward of the segments. The guide ring has fingers that engage slots in the backs of each of the segments. The fingers and vertical slots allow the segments to move axially, but prevent them from rotating relative to the guide ring. A clutch ring applies a frictional force to the guide ring to resist rotation until the segments engage the tendon threads.

U.S. Pat. No. 4,871,282 describes a tension leg floating platform for offshore drilling that has a plurality of tendons extending from the sea floor to the platform in tension. The upper connector for each tendon includes a housing with a conical shoulder located therein. A terminal segment on the upper end of each tendon extends through the housing. Dogs are carried on the shoulder of the housing, each having threads on the interior for mating threads formed on the terminal segment. A cam ring moves the dogs from an outer retracted position to an inner engaged position. The cam ring can also rotate the dogs relative to the terminal to mesh the threads of the dogs with the threads of the terminal segment.

U.S. Pat. No. RE38,458 (a reissue of U.S. Pat. No. 5,984,585) describes a vertical stab tendon bottom connector for the tendon of a tension leg platform that uses a latch ring with an outer profile to engage a mating profile in a receptacle on the sea floor. The latch ring moves radially within a housing, relative to the receptacle, between an engaged position and a retracted position. The latch ring engages the receptacle by lowering the connector into the receptacle below the mating profile and then lifting it until the latch ring locks into the receptacle. The latch ring disengages the receptacle by lowering the connector beyond a recess located below the mating profile and then lifting the connector out of the receptacle. As the connector is lifted above the recess, a retaining ring is actuated by the recess to retain the latch ring in its retracted position.

U.S. Pat. No. 6,007,275 describes an apparatus employing a stopper chain locking mechanism for tension-leg platform tendons. The mechanism comprises a chain which is attached to the tendon and a stopper for attaching the chain to the platform.

U.S. Pat. No. 6,789,981 describes a vessel that includes a riser and/or tendon tensioning construction. A connector, such as an arm or deck structure, is suspended from cables movable relative to cable guides. The connector carries two or more risers and/or tendons extending from a subsea structure to above water level. The free ends of the cables are attached to weights for exerting a tensioning force on the risers, which are substantially decoupled from pitch, roll and heave motions of the vessel.

U.S. Pat. No. 4,468,205 describes a single point mooring apparatus adapted for securing large marine tanker vessels or subsea hydrocarbon well collection and storage barges in relatively shallow water. The floating mooring buoy structure is connected to a mooring base secured to the ocean floor by a plurality of tension leg attachment members of predetermined length. The buoyancy of the floating buoy structure is controlled to produce sufficient tension in the attachment member to provide a position restoring force to the moored marine vessel. The floating buoy structure is formed by an open frame work having a conical shape to minimize impact with ice floes on the floating buoy structure and have fully submerged buoyancy tanks to minimize the effect of wave forces and tied level variations on the position restoring force.

BRIEF SUMMARY OF THE INVENTION

Disclosed herein is an apparatus and method for restraining the tendon top connector of a moored, floating structure such as a TLP in a reverse loading condition. The design allows a small controlled movement upward until the tendon top connector bowl contacts a surrounding hemispherical dome. Contact with the hemispherical dome allows the tendon top connector to transfer the load back to the tendon porch throughout a range of tendon angles. The dome may be attached by segmented clamps to a mating flange on the tendon porch. The segmented clamps may be bolted into the lower flange with clamp bolts, which allow the dome to be preloaded to the lower flange. The lower flange may be welded or otherwise secured to the tendon porch structure. The dome and the tendon top connector bowl are preferably sized to provide a small clearance between the two elements so that under normal operating conditions the tendon top connector can rotate through its center of rotation without interference with the dome. Under a reverse loading condition, the load path is provided from the length adjustment joint of the tendon, through slips gripping the length adjustment joint, through the bowl, through the dome, through the segmented clamps, and finally into the lower flange attached to the tendon porch.

BRIEF DESCRIPTION OF THE SEVERAL VIEWS OF THE DRAWING(S)

DETAILED DESCRIPTION OF THE INVENTION

The buoyancy of a typical tension leg platform (TLP) comes from a combination of pontoons and columns. Vertical tendons from each corner of the platform to the sea floor foundation piling hold the TLP below the level of what would be its free-floating state. Vertical riser connected to the subsea wellheads directly below the TLP bring oil and gas to dry trees on the deck. Catenary risers such as steel catenary risers (SCRs) may bring fluids to and from the platform from laterally remote locations on the sea floor.

The vertical tendons are typically steel tubes, 24 to 32 inches in diameters with wall thicknesses between 1 and 2 inches. With these tendons under constant tension, there is very little vertical movement at the deck, even in heavy weather. However during a design storm—the strongest wind and sea conditions for which the structure is designed—the TLP deck may move laterally as much as 8% of the water depth. Accordingly, the tendon connectors must be able to accommodate the angular movement corresponding to such an offset.

A tension leg platform (TLP) is anchored to the seabed through an array of tendons that are secured to porch structures attached to the hull of the floating platform. A TLP will typically have six, eight, or twelve tendon porches. In the event that relative motion occurs between the porch and the tendon, the result can manifest itself in an upward force trying to lift the connector off of the tendon porch. Connectors of the prior art are primarily designed for a tendon always loaded in tension and not for reverse loading—an upward force on the tendon top connector. This invention allows forces resulting from a reverse loading condition of the tendon to be transferred from the connector to the tendon porch without damaging the tendon top connector.

Figure 1:
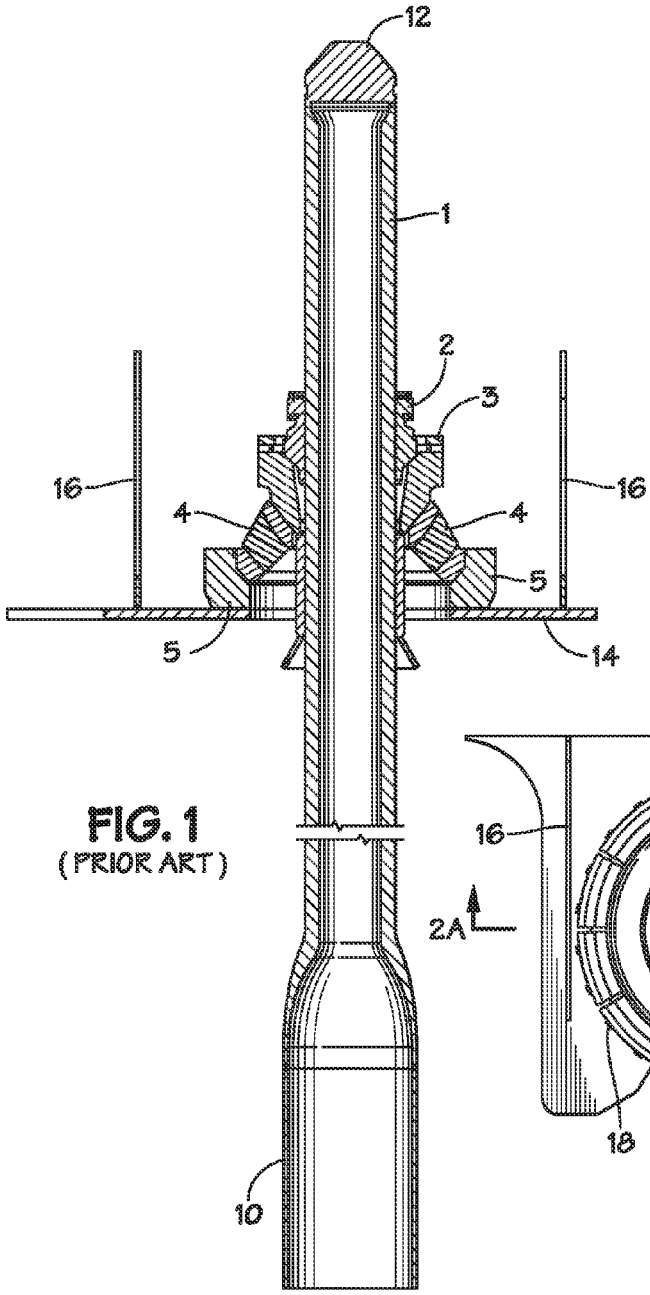
FIG. 1 (PRIOR ART)
FIG. 1 is a cross-sectional view of a tendon secured by a tendon top connector of the prior art.
Figure 3:
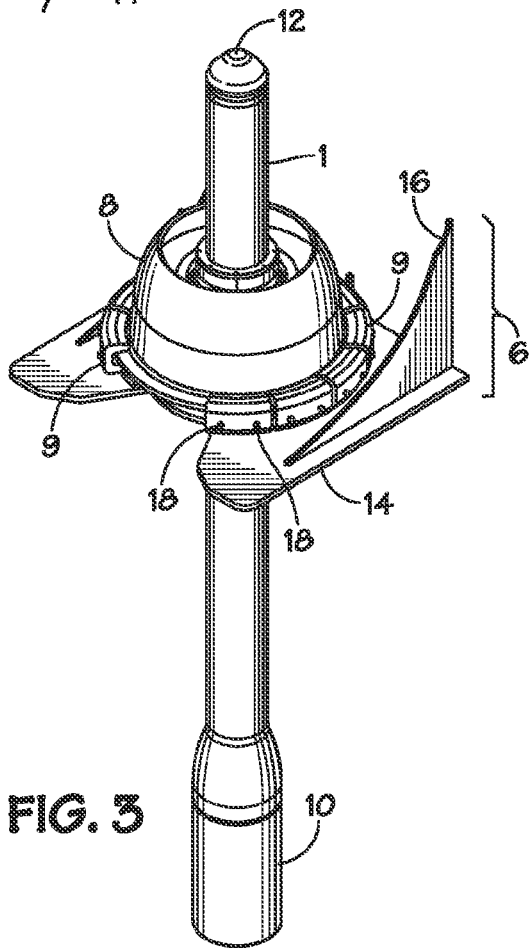
FIG. 3 is an isometric view of the tendon, tendon top connector and tendon porch shown in FIG. 2A.

FIG. 1 depicts a typical tendon top connector assembly of the prior art. Tendon 10 has an upper portion of reduced diameter which comprises length adjustment joint 1, terminating in cap 12. A tendon porch (6 in FIG. 3) comprised of porch flange 14 reinforced by buttress plates 16 is mounted to the exterior of a TLP hull (not shown).

Tendon tension is transferred through the length adjustment joint 1 of tendon 10 through slips 2, bowl 3, flex bearing 4, bearing plate 5, and to the tendon porch 6. The tendon porch 6 may be welded to the main hull of the platform or to its pontoons, as is conventional in the art. The tendon top connectors of the prior art are designed for tension loading and can only handle a small upward load. If one locks down bearing plate 5 to the tendon porch, any upward loading must pass through flexible bearing 4 and will result in a failure of this item inasmuch as its laminated construction will not withstand significant tensile loading. In addition, if bearing plate 5 is not locked down to tendon porch 6, then the tendon top connector may lift off in an uncontrolled fashion possibly allowing tendon 10 to disconnect from the TLP hull.

Figure 2B:
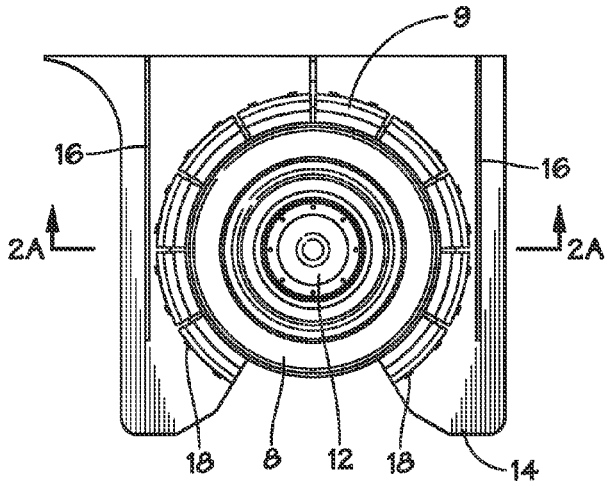
FIG. 2B is a top plan view of the tendon, upper tendon connector and tendon porch shown in FIG. 2A. Section line 2A-2A indicates the plane of FIG. 2A.
Figure 2A:
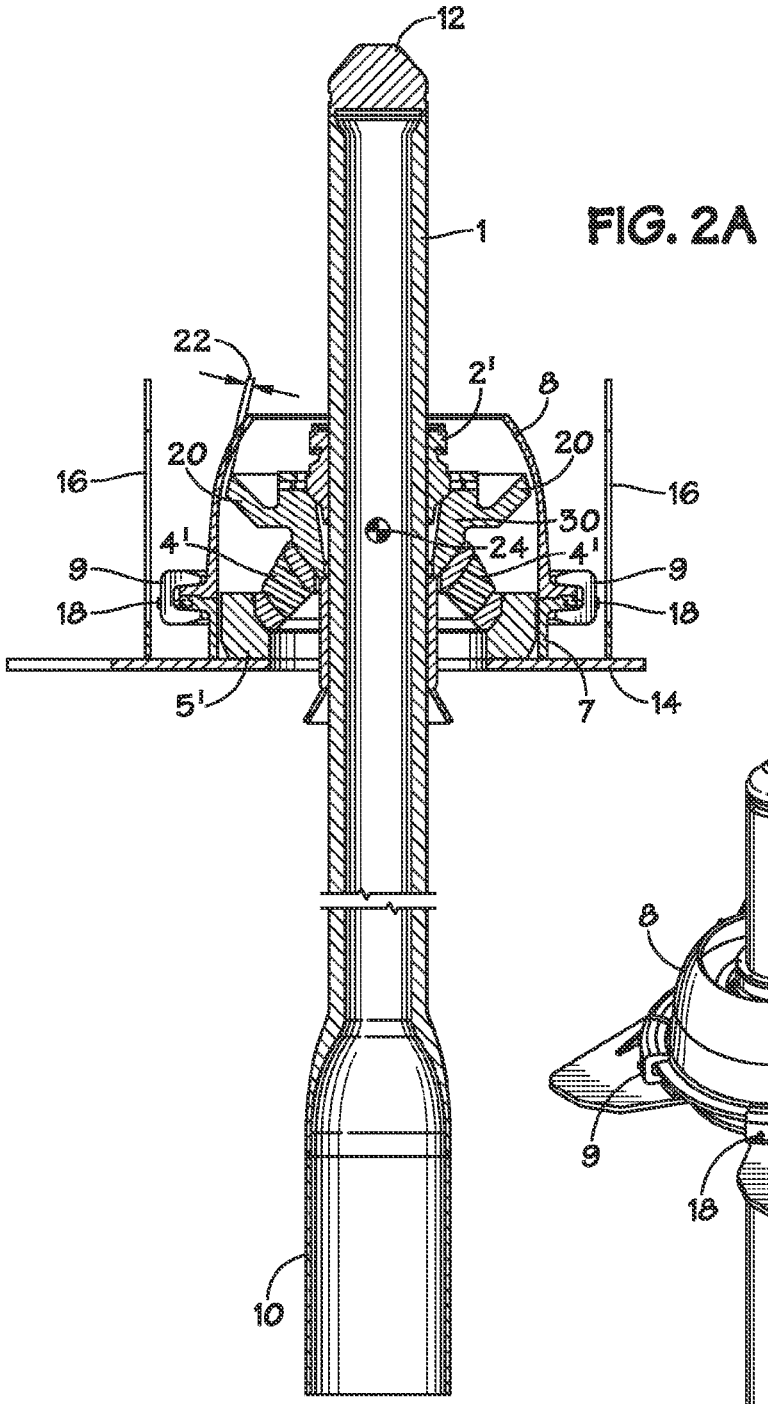
FIG. 2A is a cross-sectional view of a tendon of the prior art secured by an upper tendon connector according to one embodiment of the invention.

An apparatus for restraining the tendon top connector during a reverse loading condition is shown in FIG. 2. The illustrated apparatus allows a small, controlled movement upward until the extension 20 of tendon top connector bowl 30 contacts the interior surface of dome 8. The hemispherical shape of the contact portion of dome 8 allows the tendon top connector to transfer the load back to the tendon porch throughout a range of tendon angle. Dome 8 may be attached to mating flange 7 by means of segmented clamps 9. The segmented clamps 9 may be bolted into the lower flange 7 with clamp bolts 18, which allow dome 8 to be preloaded to lower flange 7. Lower flange 7 may be welded or otherwise attached to tendon porch structure 6. Dome 8 and tendon top connector bowl 30 are preferably sized to minimize the clearance 22 between one another such that, under normal operating conditions, the tendon top connector can rotate through its center of rotation 24 (as permitted by flex bearing 4') without interference with dome 8. Under a reverse loading condition bowl extension 20 will contact the inner surface of dome 8 and the load path will be from length adjustment joint 1, through slips 2', through bowl 30, through dome 8, through segmented clamps 9, and finally into lower flange 7 attached to tendon porch 6.

The clamps 9 illustrated in FIG. 2 comprise individual segments that may be bolted to the lower flange with clamp bolts 18. However, the clamping of dome 8 to the lower flange 7 can also be achieved using hinged segments that are secured to dome 8 and lower flange 7 by tightening a bolt and trunnion [a cylindrical protrusion used as a mounting point] assembly. Another attachment method for securing dome 8 and lower flange 7 together may comprise through bolting across the flanges using a conventional flange-type pattern.

Although the illustrated embodiment shows the application of the invention to a TLP tendon connector, the invention may also be applied to other moored, floating structures such as tension leg buoys and the like as well as other connectors which need to resist a reverse loading condition while providing some degree of angular movement. For example, subsea riser baskets—structural frames designed to hold the top end of risers coming from subsea completions—may also benefit from the invention. Relative motion between the platform and the riser necessitates a connector that allows for movement about a center of rotation. Risers, like TLP tendons, are normally loaded in tension, but severe environmental conditions can produce transient reverse loading situations. Thus, a riser connector may likewise benefit from application of the invention. Moreover, it will be appreciated that the opening in dome 8 of the apparatus can accommodate a jumper for making a fluid connection to the riser.

Although the invention has been described in detail with reference to certain preferred embodiments, variations and modifications exist within the scope and spirit of the invention as described and defined in the following claims.

What is claimed is:

1. A tendon top connector for a moored, floating structure comprising:

a bearing plate having a mating surface for a flex bearing;

a flex bearing having a first surface fitted to the mating surface of the bearing plate and an opposing second surface;

a bowl having a first inclined surface contacting the second surface of the flex bearing, a second inclined surface for mating with one or more slips and a substantially upwardly oriented rim extension on the outer circumference of the bowl; and, a dome attached to the bearing plate substantially surrounding and spaced apart from the rim extension of the bowl.

2. A tendon top connector as recited in claim 1 wherein the dome is additionally attached to a tendon porch.

3. A tendon top connector as recited in claim 1 further comprising a mating flange connected to the bearing plate and the dome.

4. A tendon top connector as recited in claim 1 wherein the dome is attached to the bearing plate by means of a mating flange attached to the bearing plate.

5. A tendon top connector as recited in claim 4 further comprising a plurality of clamps joining the dome and the mating flange.

6. A tendon top connector as recited in claim 5 wherein the clamps are segments of a circle.

7. A tendon top connector as recited in claim 5 further comprising at least one bolt passing through at least one clamp and into a threaded hole in the mating flange.

8. A tendon top connector as recited in claim 5 wherein the dome has a substantially radial flange sized and spaced to engage the clamps.

9. A tendon top connector as recited in claim 4 further comprising bolts which pass through a hole in the dome and engage a threaded receptacle in the mating flange.

10. A tendon top connector as recited in claim 4 further comprising bolts which pass through a hole in the mating flange and engage a threaded receptacle in the dome.

11. A tendon top connector as recited in claim 4 further comprising bolts which pass through a hole in the dome and a hole in the mating flange and are secured with a threaded nut.

12. A tendon top connector as recited in claim 1 wherein the dome has a substantially circular opening on its upper surface.

13. A tendon top connector as recited in claim 1 wherein the dome comprises a section the inner surface of which is substantially hemispherical.

14. A tendon top connector as recited in claim 1 wherein the dome comprises a substantially cylindrical section and a substantially hemispherical section.

15. A moored, floating structure comprising:

a hull;

at least one tendon for securing the hull to an anchor piling in the sea floor;

at least one tendon connector attached to the hull, said tendon connector comprising:

a bearing plate having a mating surface for a flex bearing;

a flex bearing having a first surface fitted to the mating surface of the bearing plate and an opposing second surface;

a bowl having a first inclined surface contacting the second surface of the flex bearing, a second inclined surface for mating with one or more slips and a substantially upwardly oriented rim extension on the outer circumference of the bowl;

a plurality of slips engaging the at least one tendon and contacting the second inclined surface of the bowl; and, a dome attached to the bearing plate substantially surrounding and spaced apart from the rim extension of the bowl.

16. A method for restraining the tendon top connector of a tension leg platform in a reverse loading condition comprising:

providing a bearing plate having a mating surface for a flex bearing;

providing a flex bearing having a first surface fitted to the mating surface of the bearing plate and an opposing second surface;

providing a bowl having a first inclined surface contacting the second surface of the flex bearing, a second inclined surface for mating with one or more slips and a substantially upwardly oriented rim extension on the outer circumference of the bowl;

providing a dome attached to the bearing plate substantially surrounding the rim extension of the bowl; and, contacting the dome with the rim extension of the bowl such that upward movement of the bowl is restricted.

* * * * *